United States Patent [19]

Gill et al.

[11] 4,346,921

[45] Aug. 31, 1982

[54] DRAINAGE INSPECTION CHAMBERS

[75] Inventors: Anthony Gill, Swanley; John Gosden; Robert W. Parker, both of Maidstone, all of England

[73] Assignee: Reed International Limited, London, England

[21] Appl. No.: 127,629

[22] Filed: Mar. 6, 1980

[30] Foreign Application Priority Data

Mar. 13, 1979 [GB] United Kingdom ..... 7908782
May 4, 1979 [GB] United Kingdom ..... 7915727

[51] Int. Cl.[3] ..... F16L 41/00

[52] U.S. Cl. ..... 285/110; 52/20; 285/150; 285/DIG. 2; 285/DIG. 22

[58] Field of Search ..... 285/150, 110, DIG. 22, 285/DIG. 2; 52/20, 21

[56] References Cited

U.S. PATENT DOCUMENTS

| | | | |
|---|---|---|---|
| 3,233,775 | 2/1966 | Bozek | 285/DIG. 22 X |
| 3,630,547 | 12/1971 | Hartshorn | 285/150 |
| 3,791,678 | 2/1974 | De Putter | 285/110 |
| 3,913,928 | 10/1975 | Yamaguchi | 285/110 X |
| 4,112,979 | 9/1978 | Widdicombe | 285/DIG. 2 X |

FOREIGN PATENT DOCUMENTS

| | | | |
|---|---|---|---|
| 2456467 | 8/1976 | Fed. Rep. of Germany | 285/150 |
| 1480509 | 4/1967 | France | 285/110 |
| 1497402 | 1/1978 | United Kingdom | 285/150 |

*Primary Examiner*—Thomas F. Callaghan
*Attorney, Agent, or Firm*—Pollock, Vande Sande & Priddy

[57] ABSTRACT

In a drainage inspection chamber of the kind having a manhole access and a base with at least one channel in the base extending between an inlet opening and an outlet opening, the base is formed from plastics material and has an integral side wall structure, circular openings in the side wall structure constituting the inlet and outlet openings. Separately formed socket members for receiving inlet and outlet pipes are located at each of the openings, each of the socket member being provided with a resilient sealing member for sealing with the outer surface of a pipe fitted into the socket member, the sealing member also serving simultaneously to seal the socket member with the internal surface of the inspection chamber.

8 Claims, 8 Drawing Figures

DRAINAGE INSPECTION CHAMBERS

This invention relates to inspection chambers of prefabricated construction for use in drainage or sewerage systems and of the kind having a manhole access and a base with at least one channel in the base extending between an inlet opening and an outlet opening. Normally there is a main channel extending across the base between a main inlet opening and an outlet opening and a number of branch channels each extending across the base from a respective inlet opening to the main channel.

The object of the present invention is to provide an improved arrangement by which inlet and outlet pipes can connect to the inspection chamber.

According to the present invention there is provided a prefabricated inspection chamber of the kind described, wherein the base is formed from plastics material and has an integral side wall structure, circular openings in the side wall structure constituting said inlet and outlet openings, wherein separately formed socket members for receiving inlet and outlet pipes are located at each of said openings and wherein each said socket member is provided with a resilient sealing member for sealing with the outer surface of a pipe fitted into the socket member, said sealing member also serving simultaneously to seal the socket member with internal surface of the inspection chamber.

Said socket members may be located in pockets provided on the internal surface of said side wall structure, each of said socket members defining with said internal surface an annular groove locating a sealing ring constituting said sealing member, said sealing ring, at least when a pipe is fitted into said socket member also sealingly engaging the sides of said groove to effectively seal said socket member to the inspection chamber. Thus it is not necessary to solvent weld or otherwise seal said socket member to the inspection chamber.

Alternatively said circular openings may be defined by cylindrical portions, said socket members being a snap fit within said cylindrical portions and each of said socket members being provided with a sealing member which extends as a cuff over the outside of the socket member and seals with the internal surface of the cylindrical portion and which extends as an annular web into the mouth of the socket member for sealing with a pipe fitted into the socket member.

Embodiment of drainage inspection chambers in accordance with the invention will now be described by way of example with reference to the accompanying drawings, in which.

Figure 1:
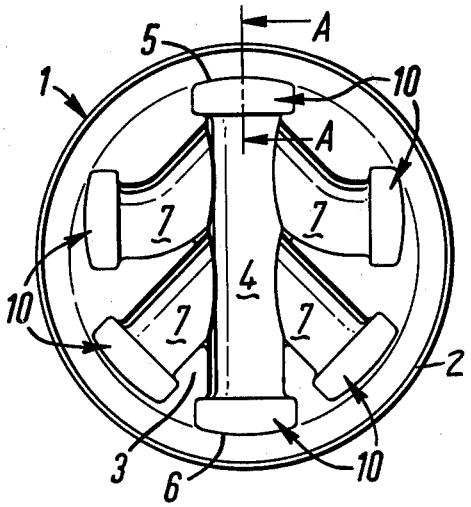
FIG. 1 is a plan view of a first embodiment of inspection chamber.
Figure 2:
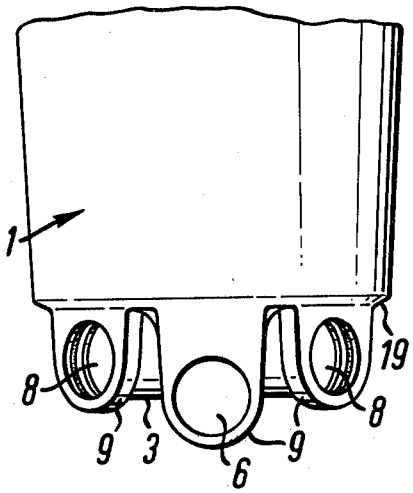
FIG. 2 is a side elevation of the lower end of the inspection chamber of FIG. 1.
Figure 5:
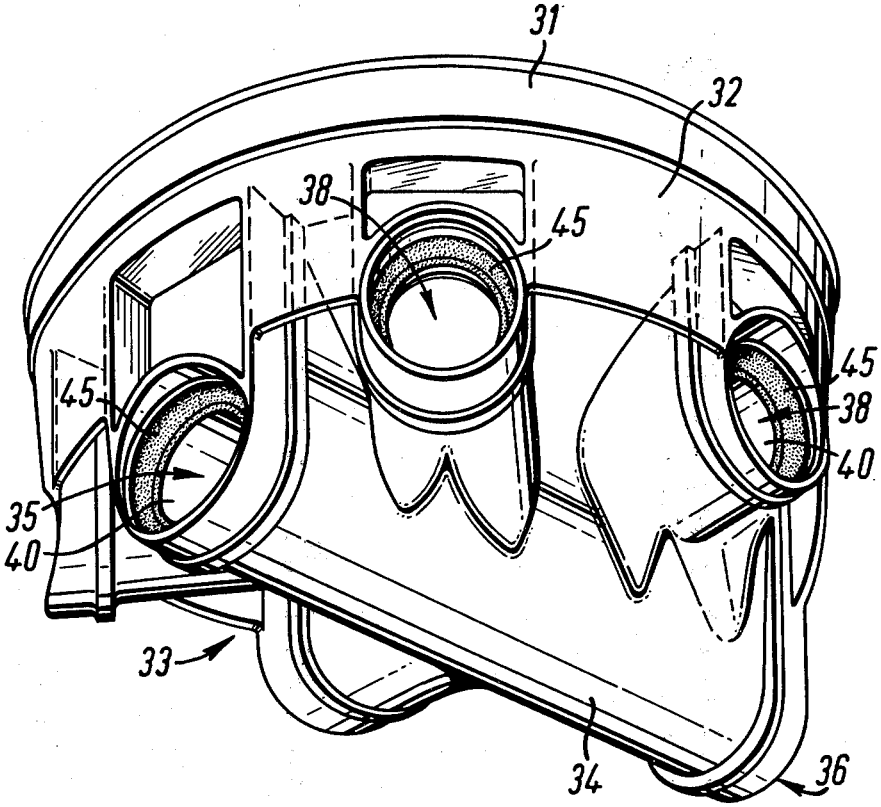
FIG. 5 is a perspective view from below of the base of a second embodiment of inspection chamber.
Figure 3:
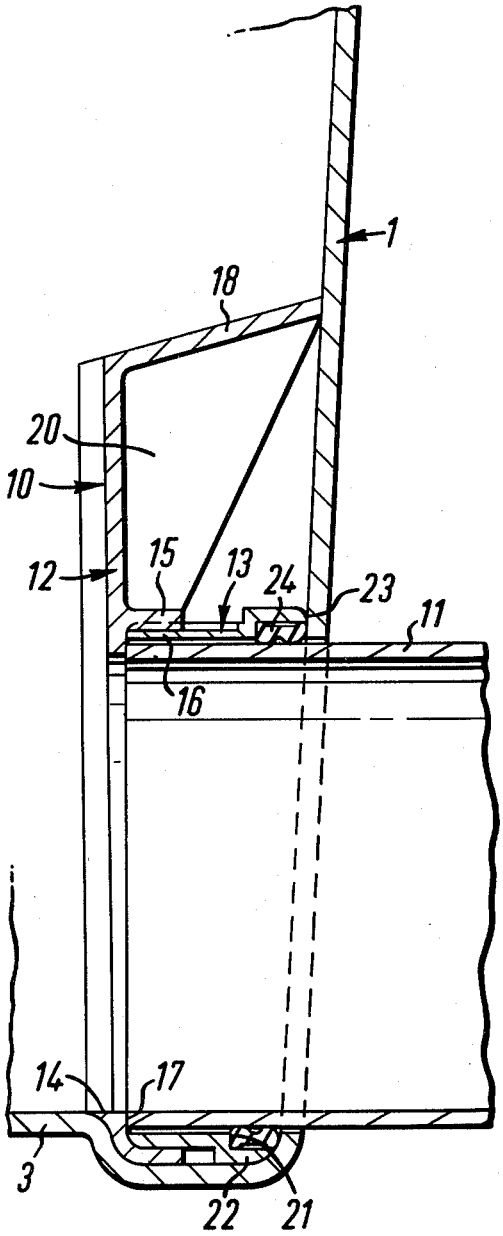
FIG. 3 is a section on the line A—A of FIG. 1.

Referring now to FIGS. 1 to 3 of the drawings, the inspection chamber has a main body 1 formed by moulding glass-fibre reinforced plastics material. The side-wall of body 1 is circular in cross-section and tapers inwardly with about a 3° taper from its upper edge 2 to integral base 3. The base 3 has a main drainage channel 4 (FIG. 1) extending across it, with a suitable fall, between a main inlet opening 5 and a main outlet opening 6. The base is also provided with four branch channels 7 connecting, with a suitable fall, with the main channel 4 and leading from respective inlet openings 8.

The inlet openings 5 and 8 and the outlet opening 6 are formed in the outer sides of pockets 9 (FIG. 2) which are shaped during the moulding of the main body 1. The inner sides of the pockets 9 open into respective ones of the channels 4 and 7. The pockets 9 are upwardly open and each of them locates a similar socket member 10, which is fitted through the top of the pocket and is a tight fit in the pocket. The socket member 10 is so dimensioned that when the spigot end 11 (FIG. 3) of a pipe is fitted to the socket member 10 its internal surface is flush with the surface of the associated channel.

Referring more particularly to FIGS. 3, the socket member 10 is formed of two interfitting parts 12 and 13. The part 12 has a circular opening whose periphery 14 is flush with the surface of the associated channel and a sleeve portion 15 of larger diameter than the circular opening for locating by a push fit a sleeve portion 16 of the part 13. Shoulder 17 between the periphery 14 and the sleeve portion 15 of the part 12 provides an abutment for limiting inward movement of the spigot end 11. The part 12 of the socket member 10 extends upwardly to provide a sloping shoulder 18 which aligns with the sloping shoulders 19 (FIG. 2) formed in the main body 1 between the pockets 9 so that crevices in which solids can collect are avoided. The part 12 of the socket member 9 is reinforced by ribs 20 extending between its sleeve portion 15 and the shoulder 18.

The part 13 of the socket member 10 at the outer end of its sleeve portion 16 steps radially outwardly through shoulder 21 and then extends axially as an annular portion 22 to its outer end. The outer edge 23 of the annular portion 22 is contoured so that when the socket member is located in the pocket 9 the outer edge 23 fits closely against the internal surface of the pocket 9. The sleeve portions 15 and 16 of the parts 12 and 13 of the socket member have a key and slot connection so that they can only be fitted together in one orientation and cannot rotate relatively to one another, thus ensuring the correct fitting of the edge 23 against the internal surface of the pocket 9.

It can be seen from the drawings that the shoulder 21, the internal surface of the annular portion 22, and the internal surface of the pocket 9 define an annular groove in which is located a sealing ring 24 for sealing with the spigot end 11. The sealing ring 24 is a sufficiently tight fit in the groove that, at least when the spigot end 11 is fitted in the socket member 10 to deform the sealing ring 24, the latter seals with the sides of the groove, thus effectively sealing the socket member 9 to the internal surface of the main body 1.

Figure 4:
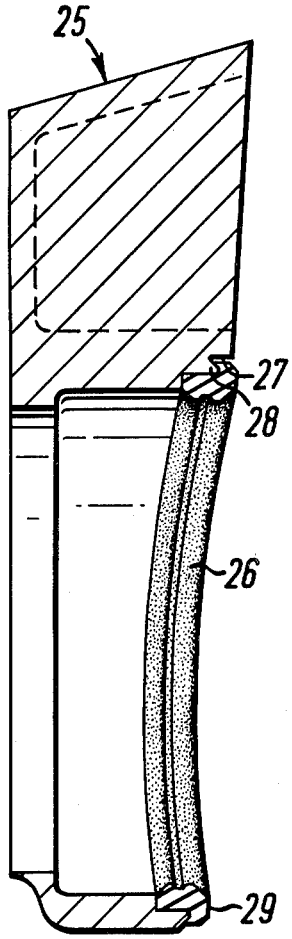
FIG. 4 is a sectional elevation of an alternative form of socket member to that shown in FIGS. 1 to 3.
Figure 6:
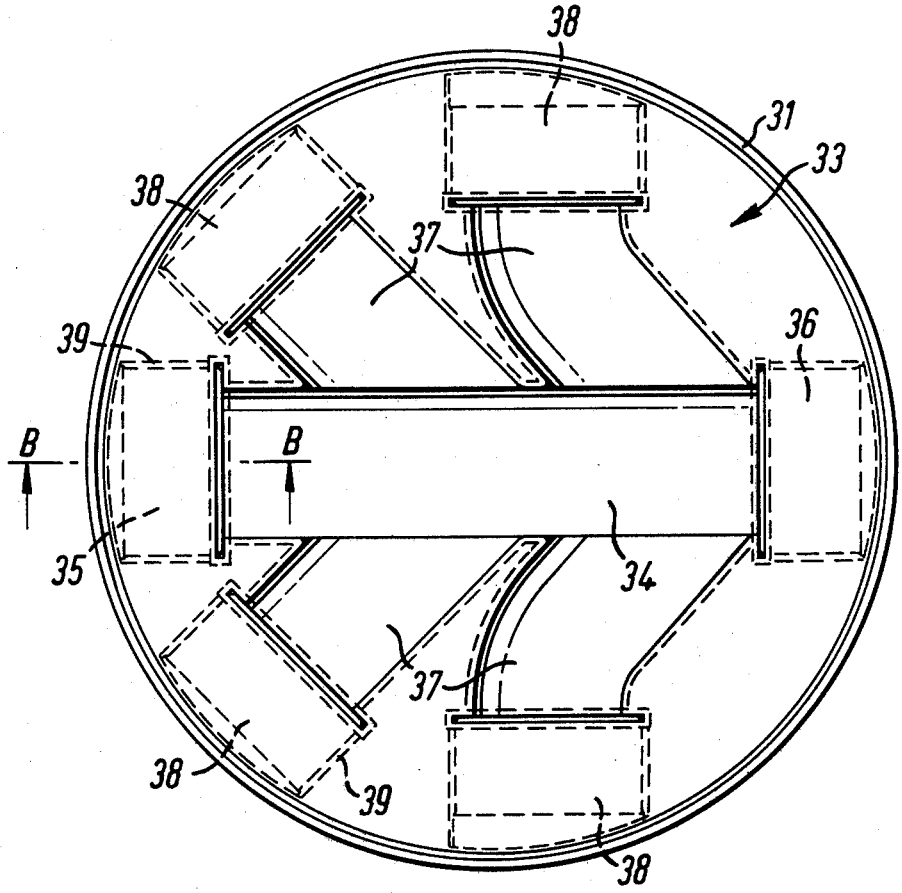
FIG. 6 is a plan view of the inspection chamber of FIG. 5.

Referring now to FIG. 4, this shows an alternative form of socket member 25 for fitting into the pockets 9 in exactly the same manner as the socket member 10, and has the same general shape as the socket member 10. It differs from the socket member 10 in that it is formed as a one-piece moulding from plastics material. Sealing ring 26 for sealing with the spigot end of a pipe is located in position at the outer extremity of the socket member 25. The outer extremity of the socket member 25 is stepped outwardly at 27 and the sealing ring 26 locates in the stepped portion. The sealing ring 26 is located in position by a tongue 28 integrally formed with the socket member 25 and which locates in a groove formation in the outer periphery of the sealing ring 26. The inner periphery of the sealing ring 26 seals with the spigot end of a pipe and the outer side face 29 of the sealing ring 26 in its undeformed condition stands slightly proud of the outer extremity of the socket member 25 so that when the socket member 25 is fitted into a pocket 9, the sealing ring 26 seals with the internal surface of the main body 1 of the inspection chamber, similar to the sealing ring 24.

Referring now to FIGS. 5 to 8 the inspection chamber has a base section as shown comprising a base and integral side wall and is formed by moulding plastics material. To form the full height of the inspection chamber further side wall sections are fitted one on the other on the base section. The base section is circular in plan view and has an upper rim 31 from which depends an integral skirt 32. Extending from the lower edge of the rim 31 and within the skirt 32 is the floor formation 33 of the base. The floor formation 33 has a main drainage channel 34 extending across it, with suitable fall, between a main inlet opening 35 and a main outlet opening 36. It is also provided with four branch channels 37 connecting, with a suitable fall, with the main channel 34 and leading from respective inlet openings 38.

Figure 7:
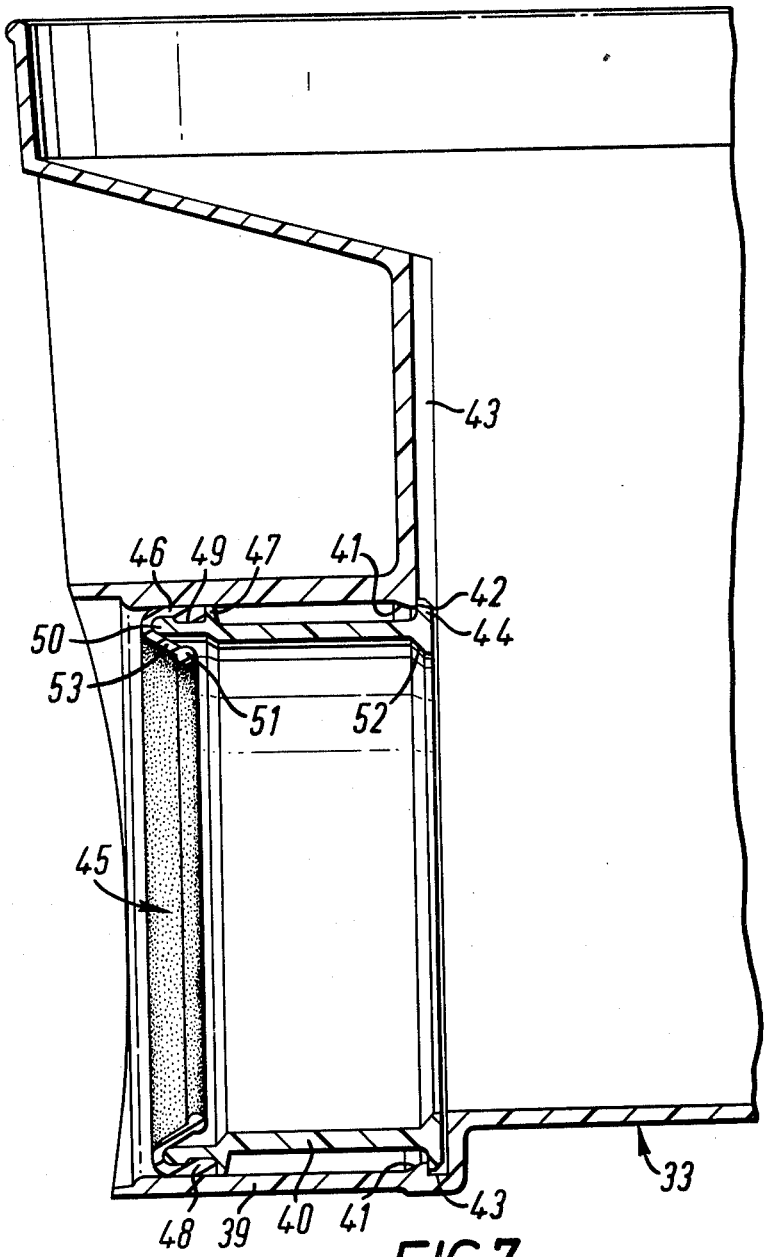
FIG. 7 is a section to an enlarged scale on the line B—B of FIG. 6.

The inlet openings 35 and 38 and the outlet opening 36 are formed during the moulding operation as cylindrical portions 39 and receive separately formed socket members 40 which are also made by injection moulding from plastics material. The socket members 40 are a snap fit in the cylindrical portions 39. To achieve this snap fit the internal surface of each cylindrical portion 39 at its inner end is formed with an annular ramp 41 which terminates at a shoulder 42 defined by one side of a groove 43 formed at the inner extremity of the cylindrical portion 39 and the socket member 40 is formed with an external flange 44. Thus as the socket member 40 is pushed into the cylindrical portion 39 it is stressed under its own inherent resilience as its flange rides along the ramp 41 until it snaps behind the shoulder 42 as best seen in FIG. 7.

The outer end i.e. the mouth, of the socket member 40 is fitted with a rubber sealing member 45. The sealing member 45 has a cuff portion 46 which fits around the outside of the socket member 40 and abuts against an external flange 47 on the socket member 40. The cuff portion 46 of the sealing member 45 also has a thickened portion 48 which locates in a shallow annular groove 49 around the outside of the socket member 40. The thickness of the cuff portion 46 is such that it is compressed when the socket member 40 is pushed into the cylindrical portion 39 and thus the socket member 40 is sealed within the cylindrical portion 49. The sealing member 45 extends from the cuff portion 46 over the rounded nose 50 of the mouth of the socket member 40 into an annular web 53 which extends into the mouth of the socket member 40 and terminates at its free edge in a bead 51. Thus when the spigot end of a pipe (not shown) is pushed into the socket member up to internal shoulder 52 so that its internal surface aligns with the associated drainage channel, the spigot end is sealed in the socket member by the sealing member 45.

Figure 8:
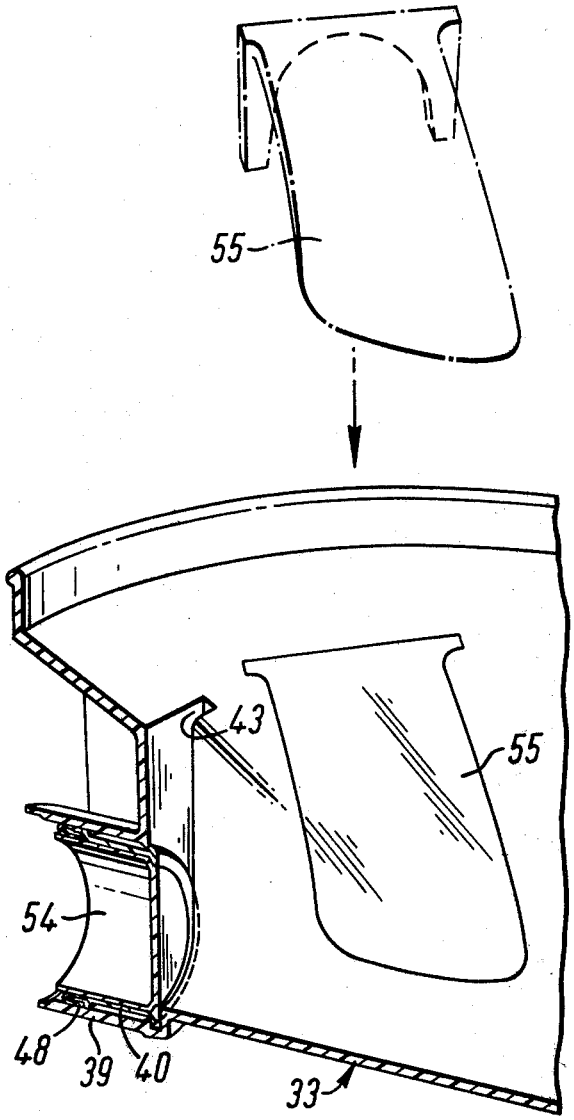
FIG. 8 is a perspective view partly sectioned of the base of FIGS. 5 to 7 showing a blanking plug in position in one of the openings and with a shroud for fitting over the inner end of the blanked off opening.

If only some of the inlets 38 are required to be connected to pipes, the remainder may be blanked off by simple plugs 54 as shown in FIG. 8. However, to avoid the build up of debris in the unused channels, suitable aprons or shrouds 55 can be fitted and located over the inner ends of the socket members in the extended groove 43, as indicated in FIG. 8.

Although the base of the inspection chamber is shown with a narrow rim 31, this rim could be replaced by a wall which extends the full length of the drainage inspection chamber.

We claim:

1. A drainage inspection chamber of prefabricated plastics construction having a manhole access and a base with at least one channel in the base extending between an inlet opening and an outlet opening, the base of said prefabricated inspection chamber being formed from plastics material and having an integral side wall structure, circular openings in the side wall structure constituting said inlet and outlet openings, separately formed socket members for receiving inlet and outlet pipes, said separately formed socket members being located at each of said openings, and each said socket member being provided with a resilient sealing member for sealing said socket member with the outer surface of a pipe fitted into the socket member, each said sealing member being so configured and being so arranged relative to its associated socket member that said sealing member also serves simultaneously to seal said associated socket member with the internal surface of the inspection chamber.

2. A drainage inspection chamber according to claim 1 wherein said socket members are located in pockets provided on the internal surface of said side wall structure, each of said socket members defining with said internal surface an annular groove locating a sealing ring constituting said sealing member, said sealing ring, at least when a pipe is fitted into said socket member, also sealingly engaging the sides of said groove to effectively seal said socket member to the inspection chamber.

3. A drainage inspection chamber according to claim 2, wherein said pockets are upwardly open and said socket members are fitted through the tops of the pockets.

4. A drainage inspection chamber according to claim 1, wherein said circular openings are defined by cylindrical portions, said socket members being a snap fit within said cylindrical portions and each of said socket members being provided with a sealing member which extends as a cuff over the outside of the socket member and seals with the internal surface of the cylindrical portion and which extends as an annular web into the mouth of the socket member for sealing with a pipe fitted into the socket member.

5. A drainage inspection chamber according to claim 4, wherein the snap fit is provided at one end of the socket member and the sealing member at the other.

6. A drainage inspection chamber according to claim 4 or claim 5 wherein said snap fit is provided by a ramp over which a flange on the socket member rides to stress the socket member under its own resilience so that the flange snaps behind a shoulder at the end of ramp.

7. A drainage inspection chamber according to claim 4 or claim 5, wherein one of said socket members is closed off by a plug fitting as a pipe into said socket member and sealing with the web of said sealing member and an apron fits over the inner end of the closed-off socket member and slopes away from the end of said closed-off socket member to prevent the build up of debris in the channel associated with the closed-off socket member.

8. A drainage inspection chamber according to claim 7, wherein said apron locates at its upper end in grooves in said inspection chamber.

* * * * *